US005956781A

United States Patent [19]

Grant

[11] Patent Number: 5,956,781

[45] Date of Patent: Sep. 28, 1999

[54] DUAL FLUSH CISTERN

[75] Inventor: Donald Grant, Glen Alpine, Australia

[73] Assignee: James Hardie Research Pty Limited, Australia

[21] Appl. No.: 08/603,356

[22] Filed: Feb. 20, 1996

Related U.S. Application Data

[63] Continuation-in-part of application No. 08/256,881, filed as application No. PCT/US93/00027, Mar. 21, 1993, abandoned.

[51] Int. Cl.[6] ..... E03D 1/14

[52] U.S. Cl. ..... 4/325

[58] Field of Search ..... 4/324, 325, 390, 4/391

[56] References Cited

U.S. PATENT DOCUMENTS

| | | | |
|---|---|---|---|
| 4,149,283 | 4/1979 | Knudtson | 4/324 |
| 4,527,296 | 7/1985 | Musgrove | 4/324 |
| 5,040,247 | 8/1991 | Stevens | 4/324 |
| 5,305,474 | 4/1994 | Nardi et al. | 4/324 |
| 5,720,053 | 2/1998 | Menge | 4/325 |

FOREIGN PATENT DOCUMENTS

| | | | |
|---|---|---|---|
| 18637/83 | 12/1983 | Australia . | |
| 29039/84 | 12/1985 | Australia . | |
| 3319686 | 12/1983 | Germany | 4/324 |

*Primary Examiner*—Charles E. Phillips
*Attorney, Agent, or Firm*—Marshall & Melhorn

[57] ABSTRACT

The present invention relates to a dual flush cistern. The cistern incorporates a flushing valve 12 located in the base of the cistern, the flushing valve 12 having a stem 11 able to be lifted to open the flushing valve 12. Float 30 is fixed to stem 11 and is mounted within float housing 13. Float housing 13 is mounted relative to the cistern such that it is below the normal water level when the cistern is full and above the normal water level following a partial flush. The closure of flushing valve 12 is dependant on float 30 which falls with the water level within float housing 13. The drainage rate of water from float housing 13 is controllable in response to the type of flush desired.

7 Claims, 4 Drawing Sheets

DUAL FLUSH CISTERN

This application is a continuation-in-part of application Ser. No. 08/256,881,filed Oct. 18, 1994, abandoned, which is a 371 of PCT/US 93/00027 filed Jan. 21, 1993.

TECHNICAL FIELD

The present invention relates to a flushing mechanism for a toilet cistern and more particularly to a dual flush cistern.

BACKGROUND ART

A variety of systems have been used to provide a mechanism for giving dual flushes of different volumes. These range from complicated mechanical linkage systems to the provision of different chambers within the cistern. The present invention seeks to provide a simple system of providing a dual flush without the problems associated with the known systems.

DISCLOSURE OF INVENTION

According to the present invention there is provided a dual flush cistern having a flush selection and actuation mechanism mounted therewith having a full flush actuator and a partial flush actuator, a flushing valve positioned in the base of the cistern, said flushing valve having a stem able to be lifted to open the flushing valve by a lifting mechanism of said flush selection and actuation mechanism, a float housing mounted to the cistern having a base portion and wall portions extending upwardly from the base portion and housing a float connected to said stem, said housing mounted relative to the cistern such that it is below the normal water level when the cistern is full and above the normal water level following a partial flush, said housing having outlet means therein to enable water to drain therefrom, said outlet means being controllable to provide at least first and second drainage rates from said housing, said second drainage rate being faster than first drainage rate, said outlet means responsive to actuation of the partial flush actuator of the flush selection and actuation mechanism to cause drainage from said housing at said second rate and responsive to actuation of the full flush actuator of the flush selection and actuation mechanism to cause drainage from said housing at said first rate.

For preference, said outlet means comprises first and second openings in said housing, the second opening being selectively openable and closable by a control means, said control means being operative to open said said second opening in response to actuation of the partial flush actuator of the flush selection and actuation mechanism. For preference, said second opening provides a faster drainage rate than the first opening. Preferably, the control means comprises a slidable gate positioned in said second opening and responsive to operation of said partial flush actuator to open said second opening and responsive to said float reaching the base of said float housing to close said second opening. Preferably said housing is an annular housing positioned around said stem. For further preference said float is annular and is positioned around said stem. Preferably, the float housing is adjustably mounted to said cistern so that its vertical position relative to the cistern can be adjusted. For preference, the slidable gate is coupled to the partial flush actuator by an adjustable linkage so that the degree of opening of the slidable gate in response to the operation of the partial flush actuator is adjustable.

BRIEF DESCRIPTION OF DRAWINGS

A preferred embodiment of the present invention will now be described, by way of example only, with reference to the accompanying drawings, in which.

BEST MODE OF CARRYING OUT THE INVENTION

Figure 1:
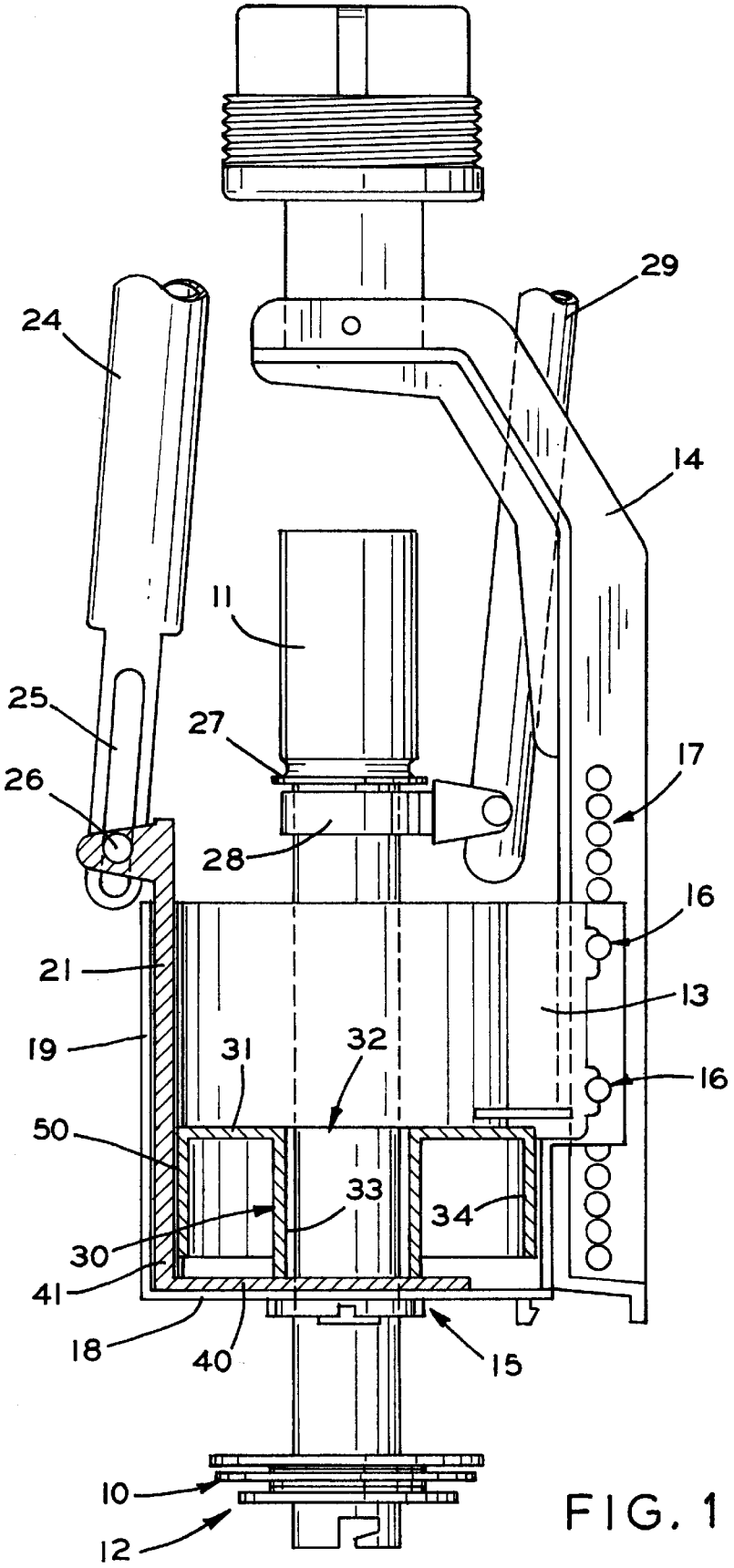
FIG. 1 is a sectional view taken through the centre of the float housing of the cistern according to the invention.
Figure 2A:
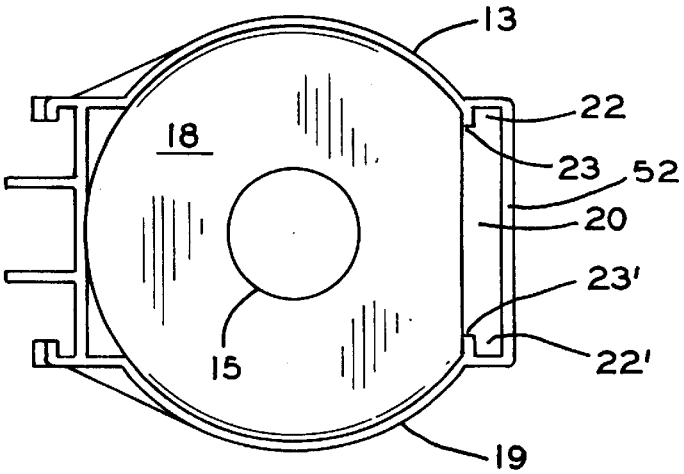
FIG. 2*a* is a plan view of the float housing of FIG. 1.
Figure 2B:
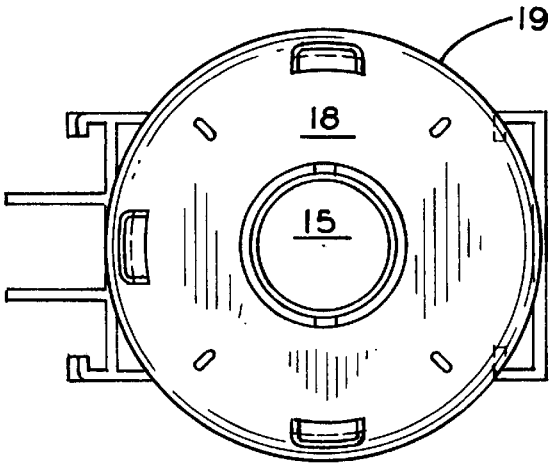
FIG. 2*b* is a underside view of the float housing of FIG. 1.
Figure 2C:
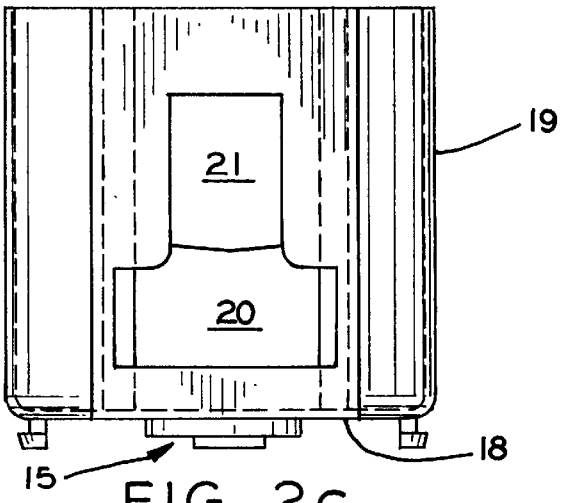
FIG. 2*c* is a elevation view of the float housing of FIG. 1.
Figure 3B:
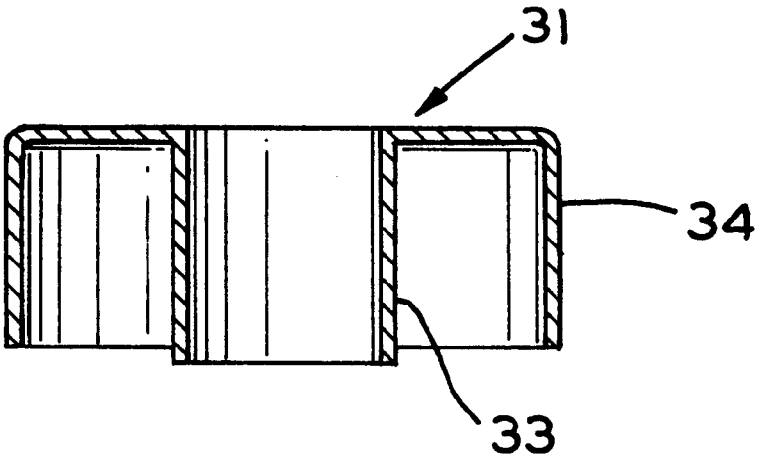
FIG. 3*b* is a sectional elevation view of the float of FIG. 1 taken on lines 3b—3b.
Figure 3A:
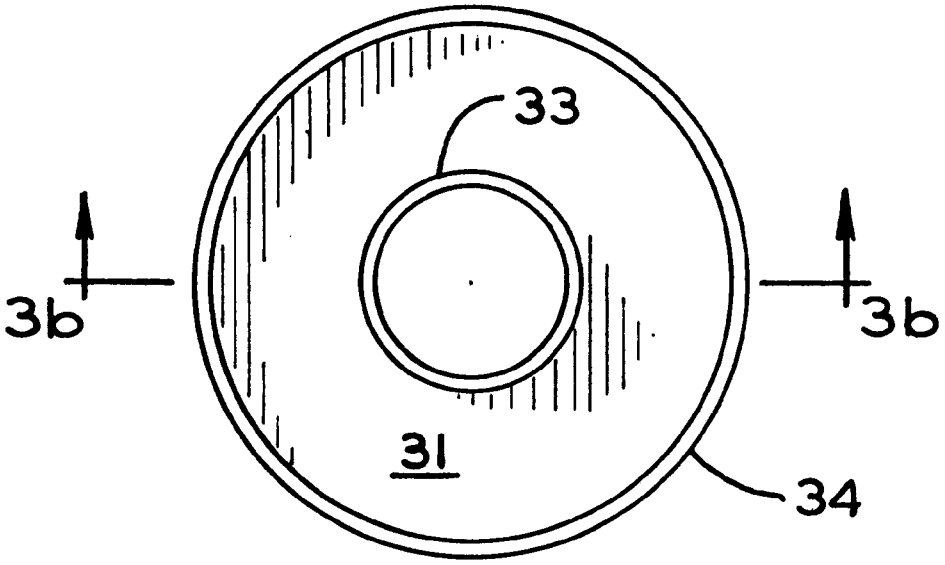
FIG. 3*a* is a plan view of the float of FIG. 1.

Referring to the drawings, the dual flushing mechanism according to this embodiment comprises a cistern having a floor of substantially conventional construction. The floor (not shown) is provided with an outlet in substantially conventional fashion which is able to be opened and closed by an annular seal 10 at the lower end of a hollow stem 11 which in this embodiment also acts as an overflow tube. The seal 10 and the outlet (not shown) together constitute a flush valve 12 while the stem 11 constitutes an overflow tube through which water can pass to the outlet should the level of water in the cistern exceed the intended maximum level.

As best seen in FIG. 1, the stem 11 is provided with an annular float housing 13 which is supported in cantilevered fashion by a connecting bracket 14 which is fixed relative to the cistern. The float housing 13 sits around the stem 11 while allowing the stem to move freely through its central opening 15. The float housing 13 is adjustably attached to the connecting bracket 14 by removable pins 16 which engage with a series of vertically spaced adjustment holes 17 provided along the length of the connecting bracket 14.

The float housing 13 has a base 18 and an annular wall 19 extending upwardly from the base to form the housing. The base 18 is provided with the central opening 15 for the stem 11 to pass through. The annular wall 19 is provided with an opening 20 which is openable and closable by a vertically movable gate 21. The gate is slidingly fitted to the opening 20 by means of a pair of channels or grooves 22, 22' extending adjacent the vertical sides 23, 23' of the opening 20. The float housing gate 21 is connected at its upper edge to a gate lifter arm 24 by means of a longitudinal elongate slot 25 and pin 26 respectively provided in the lifter arm 24 and gate 21. This arrangement allows the gate 21 to move upwardly relative to the lifter arm 24 while still enabling the lifter arm 24 to raise the gate 21 when the lifter arm 24 moves upwardly relative to the gate 21. The lifter arm 24 is adjustable in length so that the degree of opening of the gate 21 may be varied.

The stem 11 is provided with a circumferentially extending rib 27 towards its upper end which is engaged by a lifting yoke 28 pivotally connected to a full flush lifting arm 29.

An annular float 30 comprises an upper side 31 having a central opening 32, an inner wall 33 extending downwardly from the periphery of the opening 32 and an outer wall 34 extending downwardly form the outer periphery of the upper side 31. The buoyant nature of annular float 30 is provided by air trapped in the space between upper side 31, inner wall 33 and outer wall 34. Additionally or alternatively annular float 30 may be formed of a buoyant material such as an expanded polymer. The stem 11 passes through the opening 32 and the float 30 is fixed to the stem 11. The float 30 is dimensioned to fit neatly within the float housing 13 while still allowing for free vertical movement therein.

Figure 4A:
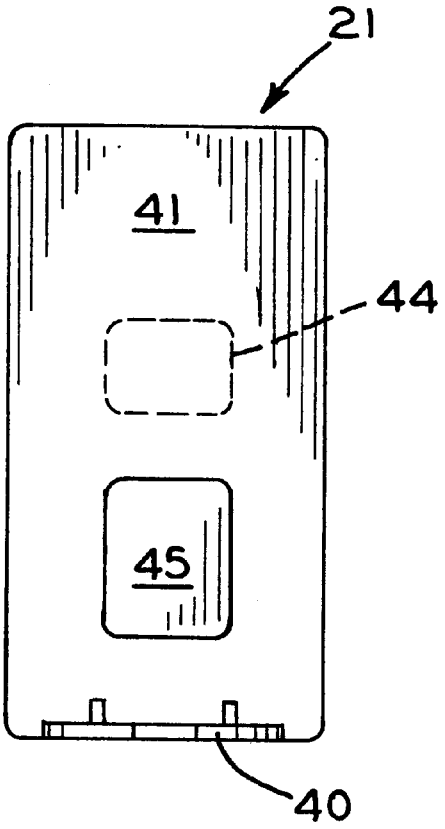
FIG. 4*a* is an elevation view of the float housing gate of FIG. 1.
Figure 4C:
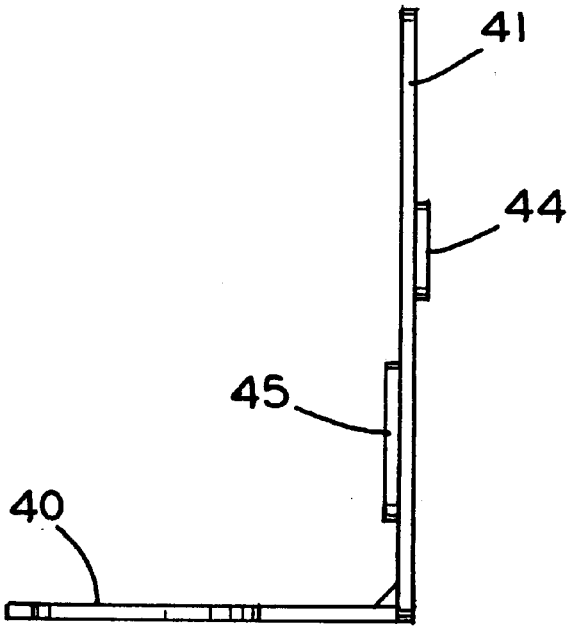
FIG. 4*c* is a side elevation view of the float housing gate of FIG. 1.
Figure 4B:
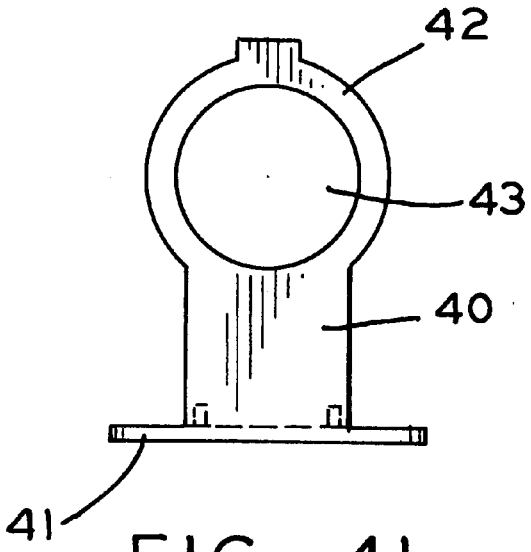
FIG. 4*b* is a underside view of the float housing gate of FIG. 1.

The float housing gate 21 will now be described in more detail with reference to FIG. 4. The gate comprises a base portion 40 and a vertically extending side portion 41. As best shown in FIG. 4*a*, the base portion 40 is provided with an enlarged section 42 through which extends a circular opening 43, which, in use, slidingly accommodates the stem 11. The side portion 41, as best shown in FIGS. 4*b* and 4*c*, is provided with a pair of vertically spaced protrusions 44 and 45 on opposite sides of the side portion 41.

In use the system operates as follows. Prior to flushing, the upward bias on stem 11 produced by float 30 is resisted by the downward bias on stem 11 produced by water pressure on the upper face of flush valve 12. For a full flush, the full flush lifting arm 29 is raised by actuation of the full flush button (not shown). This arm in turn raises the stem 11 by means of the yoke 28 engaging the rib 27. Raising of the stem 11 causes the float 30 to be raised within the float housing 13 which is initially full of water while simultaneously opening flush valve seal 10 causing the water to drain from the cistern. As the water level drops within the cistern the stem is held in a raised position by the float 30 which floats on the water held in the float housing 13. Water gradually escapes from the float housing 13 around the opening 15 and the float 30 drops allowing the stem 11 to drop closing the flush valve seal 10 by which time a full flush as been completed.

For a reduced or half flush, the gate lifter arm 24 is raised which raises the gate 21 which in turn opens the opening 20 in the wall of the float housing 13. When the gate is raised the protrusion 44 engages the upper edge of the outer wall 19 of the float housing 13 holding the gate 21 in an open position. The base portion 40 of the gate 21 engages with the inner wall 33 of the float 30 raising the float and the stem 11 causing the flush valve seal 11 to open. As gate 21 is raised, the bottom edge of protrusion 44, which initially engages the inside surface of wall 19, rests against the upper edge of housing 13, which is the upper edge of wall 19. Prior to the flush, the water level in the cistern will be approximately level with rib 27 and housing 13 is generally submerged. Upon raising of the gate 21, the area between the base 40 of gate 21 and the base 18 of housing 13 will occupied by water. Once raised, gate 21 will be maintained on the upper edge of wall 19 in a substantially horizontal configuration due both to the frictional engagement between the upper edge of wall 19 and protrusion 44, and the water below the gate maintaining base 40. Float 30, depending upon the water level, may continue to rise.

Referring to FIG. 1, the inner and outer walls 33 and 34 of float 30 are of differing axial length. Wall 33 extends downward a greater distance than wall 34. Consequently, wall 33 engages the base portion 40 of gate 21. As the water level in the cistern drops, water in the float housing exits quickly through the opening 20 allowing the float 30 to drop more quickly and close the flush valve seal 11 before a full flush has been completed. As the float 30 drops, its neat fit within the housing 13 causes it to hit protrusion 45 and knock the protrusion 44 from the outer wall 19 of the housing 13 and causing the gate 21 to close thus resetting the system for the next flush.

The operation is adjustable by varying the amount the sliding gate opens and thus the rate of discharge of water from the float housing and also by varying the vertical position of the float housing within the cistern.

It will be appreciated by those skilled in the art that further embodiments of the invention are possible without departing from the spirit or scope of the invention described and the invention is not limited to the particular embodiment described.

I claim:

1. A dual flush cistern having a flush selection and actuation mechanism mounted therewith, said mechanism including:

a flushing valve positioned in the base of the cistern, said flushing valve having a stem which, when lifted, opens the flushing valve;

a full flush actuator for effecting lifting of said stem and opening said valve for a first predetermined interval, whereby substantially all the water is removed form the cistern;

a partial flush actuator for effecting lifting of said stem and opening said valve for a second predetermined interval, the second interval being of shorter duration than the first interval, whereby only a predetermined volume of water is removed from the cistern;

a floating housing mounted to the cistern and having a base portion and wall portions extending upwardly from the base portion and housing a float connected to said stem said housing being mounted relative to the cistern such that it is below the normal water level when the cistern is full and above the normal water level following a partial flush;

outlet means in said housing having first and second openings in said housing, the second opening being selectively openable and closable by a control means, said control means being operative to open said second opening in reponse to actuation of the partial flush actuator of the flush selection and actuation mechanism, allowing water to drain therefrom at either a first or second drainage rate, said second drainage rate being faster than said first drainage rate, wherein said outlet means is responsive to actuation of the partial flush actuator to cause drainage from said housing at said second rate and responsive to actuation of the full flush actuator to cause drainage from said housing at said first rate.

2. A dual flush cistern according to claim 1, wherein the float housing is adjustably mounted to said cistern so that its vertical position relative to the cistern can be adjusted.

3. A dual flush cistern according to claim 1, wherein said second opening provides a faster drainage rate than the first opening.

4. A dual flush cistern according to claim 1, wherein the control means comprises a slidable gate positioned in said second opening and responsive to operation of said partial flush actuator to open said second opening and responsive to said float reaching the base of said float housing to close said second opening.

5. A dual flush cistern according to claim 4, wherein said housing is an annular housing positioned around said stem.

6. A dual flush cistern according to claim 5, wherein said float is annular and is positioned around said stem.

7. A dual flush cistern according to claim 4, wherein the slidable gate is coupled to the partial flush actuator by an adjustable linkage so that the degree of opening of the slidable gate in response to the operation of the partial flush actuator is adjustable.

* * * * *